US005140931A

United States Patent [19]

Parks

[11] Patent Number: 5,140,931

[45] Date of Patent: Aug. 25, 1992

[54] KEDGE ANCHOR WITH MULTIPLE STOP MEANS

[75] Inventor: Richard D. Parks, Manlius, N.Y.

[73] Assignee: Jaquith Industries, Inc., Syracuse, N.Y.

[21] Appl. No.: 767,406

[22] Filed: Sep. 30, 1991

[51] Int. Cl.[5] ..... B63B 21/24

[52] U.S. Cl. ..... 114/304; 114/301

[58] Field of Search ..... 114/294, 297, 298, 301, 114/303-307, 310; D12/215

[56] References Cited

U.S. PATENT DOCUMENTS 4,073,256 2/1978 Rossini ..... 114/306

4,644,894 2/1987 Woodgate ..... 114/304

*Primary Examiner*—Edwin L. Swinehart

*Attorney, Agent, or Firm*—Charles S. McGuire

[57] ABSTRACT

A boat anchor having a shank which is pivotally movable relative to the other elements is designed to provide three stop positions defining terminal positions of movement of the shank in each direction. A primary stop is provided by contact of a pin extending laterally through the shank with edge portions of the crown side, between which the shank is mounted. A secondary stop, operable upon failure of the primary stop, is provided by contact of the end of the shank adjacent the pin with inner surfaces of the crown heads. A tertiary stop, operable upon failure of the secondary stop, is provided by mutual contact of edge portions of the shank and crown heads.

4 Claims, 3 Drawing Sheets

KEDGE ANCHOR WITH MULTIPLE STOP MEANS

BACKGROUND OF THE INVENTION

The present invention relates to kedge anchors, i.e., boat anchors having a shank which is rotatable relative to the other elements of the anchor. More specifically, the invention relates to a kedge anchor having multiple, successively operable stop means defining the terminal positions of rotation of the shank in each direction.

In typical kedge anchors, an elongated shank has an opening at one end for attachment of a chain or rope extending from the boat to be anchored, and is pivotally mounted at its other end for rotation through a predetermined arc relative to the other anchor elements. The other elements commonly include an elongated rod, termed a stock, extending transversely through an opening in the other end of the shank to provide the pivotal mounting, a pair of flukes and mounting structure commonly referred to as a crown. The stock, flukes and crown are welded or otherwise fixedly attached to one another.

Pivotal movement of the shank about the axis of the stock is limited to a predetermined arc, e.g., 90°, by stop means such as contact of the shank with portions of the crown. When the anchor is subjected to excessive force tending to rotate the shank beyond the stop means, the strength of the materials may be exceeded resulting in failure of the stop means. In some prior art kedge anchor designs, if the primary stop means fails, the shank may be rotated through a somewhat greater arc, coming to rest against secondary stop means. When the structure defining the stop means breaks, deforms or otherwise fails, the anchor must be discarded or repaired.

The primary object of the present invention is to provide a kedge anchor having primary stop means defining terminal positions of rotation in each direction of the shank, secondary stop means operable upon failure of the primary stop means, and tertiary stop means operable upon failure of the secondary stop means.

Another object is to provide a kedge anchor wherein the shank is rotatable about the stock through a first arc defined by first stop means, a second arc larger than the first defined by second stop means upon failure of the first stop means, and a third arc larger than the second defined by third stop means upon failure of the second stop means.

Other objects will in part be obvious and in part appear hereinafter.

SUMMARY OF THE INVENTION

The anchor of the present invention includes the usual elongated shank having an opening through which the stock passes, a pair of flukes and a crown formed by a pair of crown sides and a pair of crown heads. The flukes are welded in spaced relation along one edge to the stock and to surfaces of the crown sides. The crown sides are welded along opposite edges of each to inwardly facing surfaces of the crown heads. The stock passes through and is welded to the crown sides which are spaced from one another by a distance permitting loose positioning therebetween of the end of the shank through which the stock passes.

A pin extends transversely through, and is fixedly attached to the end of the shank adjacent its pivotal mounting. The ends of the pin extend beyond the crown sides and the parts are so configured that rotation of the shank in each direction is limited by contact of the pin with edge portions of the crown sides, thereby providing primary stop means. In the event of failure of the pin or the portions of the crown sides contacted thereby in a manner rendering the primary stop means inoperable, the shank may be rotated through a somewhat larger arc until the lower end of the shank contacts one of the inwardly facing surfaces of the crown heads, thereby providing secondary stop means. If the portions of the shank and/or crown heads defining the secondary stop means fail, the shank may be rotated through an even larger arc limited by contact of edge portions of the shank and the crown heads.

The features of construction and operation of the anchor will be more fully understood and appreciated from the following detailed description, taken in conjunction with the accompanying drawings, wherein:

DETAILED DESCRIPTION

Figure 1:
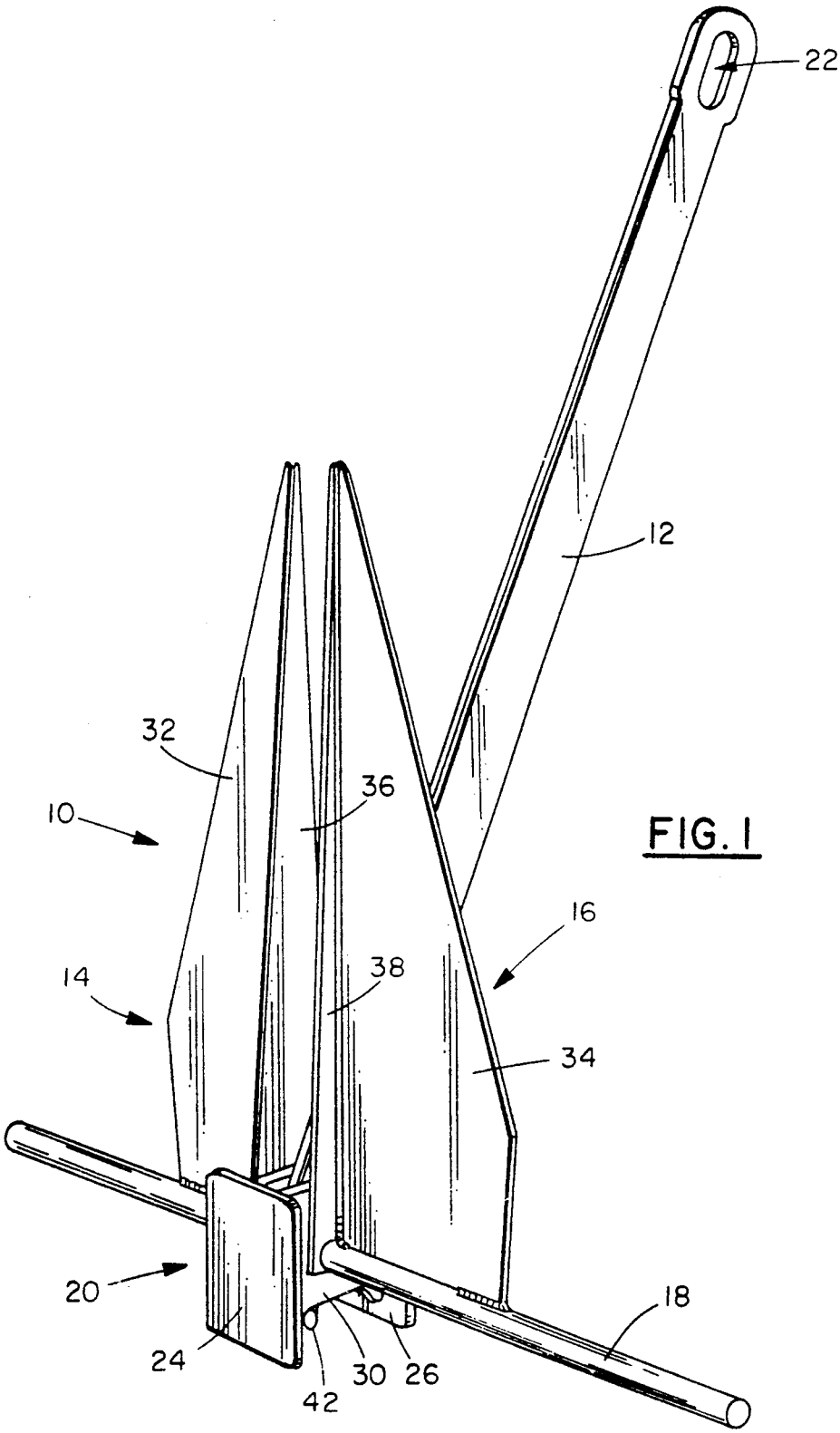
FIG. 1 is a perspective view of a kedge anchor made in accordance with the present invention.
Figure 2:
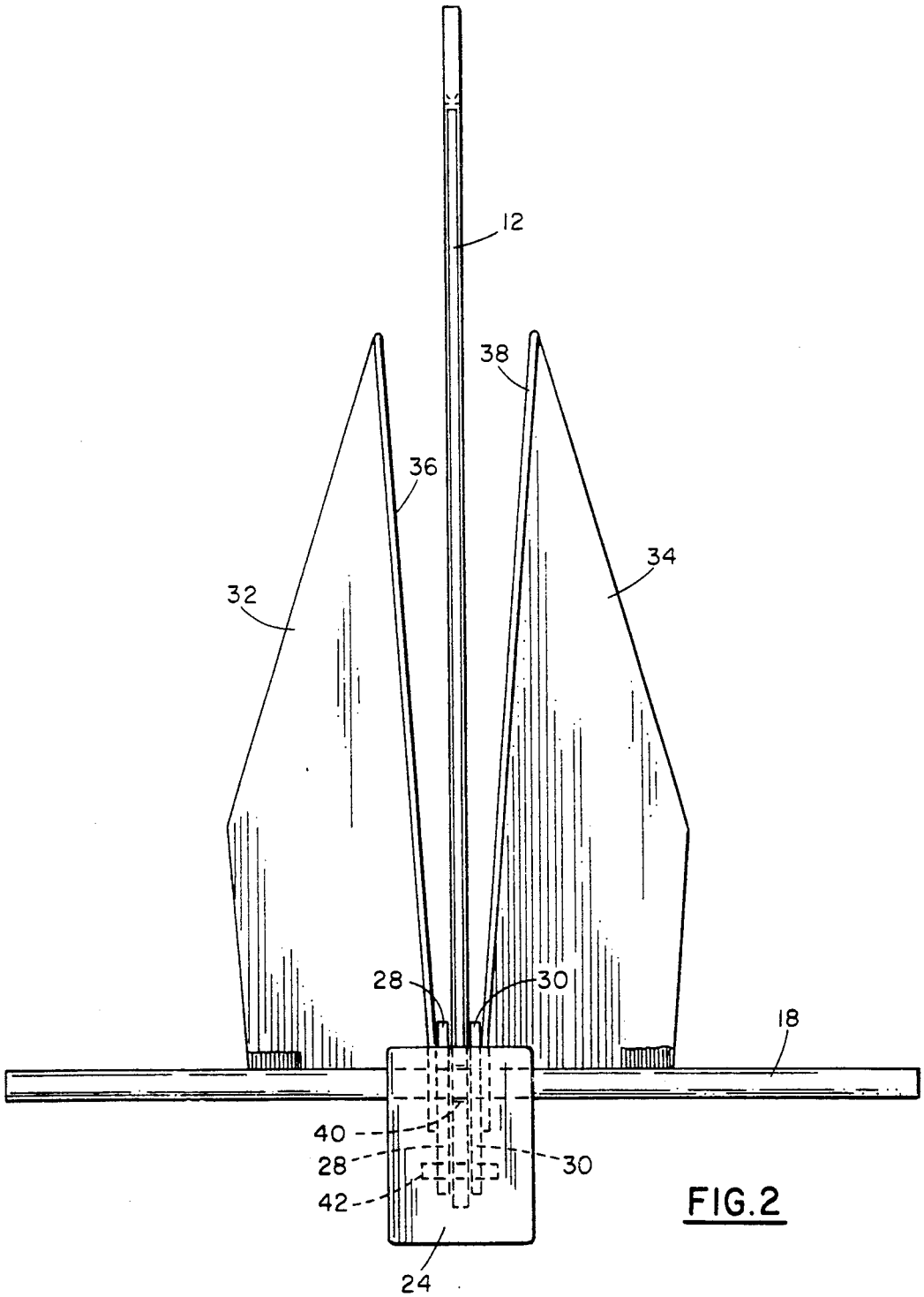
FIG. 2 is a front elevational view of the kedge anchor of FIG. 1.
Figure 3:
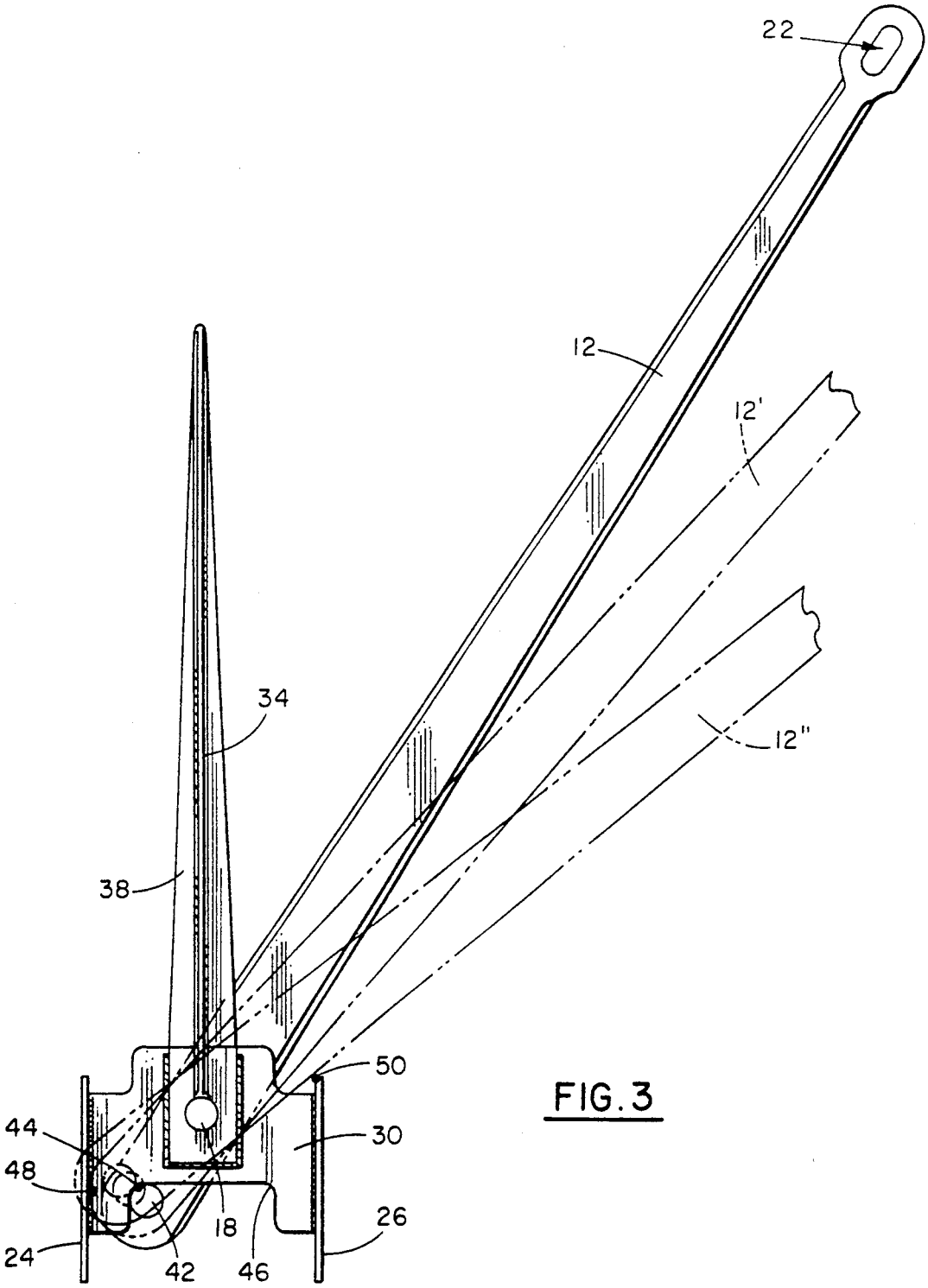
FIG. 3 is a side elevational view of the kedge anchor of FIG. 1 showing the position of the shank at each of its three terminal positions at one end of its movement.

The anchor of the invention, denoted generally by reference numeral 10, includes elongated shank 12, a pair of flukes 14 and 16, elongated stock 18 and crown 20. In the illustrated embodiment, shank 12 is in the form of a relatively flat bar having opening 22 for attachment of a chain, rope or other such tethering means (not shown) at its upper end. For convenience, terms such as upper and lower will be used to describe anchor 10 in the orientation in which it is shown in FIGS. 1-3, although it will be understood that the anchor may assume many other positions when in use.

Crown 20 is made up of two pairs of rigid plates. One pair, termed crown heads and denoted by reference numerals 24 and 26, are welded or otherwise rigidly affixed to or integral with the other pair, termed crown sides and indicated by numerals 28 and 30. Opposite, parallel edges of both crown sides 28 and 30 are welded to the opposing, i.e., inwardly facing, surfaces of crown heads 24 and 26, with the crown sides also parallel to and spaced from one another. Stock 18 passes through and is welded to crown sides 28 and 30, extending to opposite ends substantially equally spaced from the respective crown sides.

Although flukes 14 and 16 may take various, conventional configurations, in the illustrated embodiment they are essentially identical, having generally trapezoidal plates 32 and 34, and somewhat smaller, triangular plates 36 and 38 rigidly affixed to plates 32 and 34 in planes perpendicular thereto. Plates 32 and 34 are welded along their lower edges to stock 18 and plates 36 and 38 are respectively welded to the outwardly facing surfaces of crown sides 28 and 30, whereby the structure of the flukes, crown and stock are mutually, rigidly interconnected. Plates 32 and 34 are substantially coplanar and in the plane of the axis of stock 18.

Shank 12 is mounted for pivotal movement through a predetermined arc with respect to the other anchor elements. The spacing of the opposing surfaces of crown sides 28 and 30 is slightly greater than the thickness of the lower end of shank 12 which is positioned between the crown sides. Stock 18 passes through opening 40 (FIG. 2) in shank 12, and pin 42 extends laterally through the lower portion of shank 12 and is affixed thereto. The ends of pin 42 extend past the lower edges of crown sides 28 and 30 which include curved portions 44 and 46 (FIG. 3) of substantially the same radius as pin 42.

Primary stop means, defining the terminal positions of pivotal movement of shank 12 in each direction, are provided by contact of pin 42 with curved portions 44 and 46 of the lower edges of crown sides 28 and 30. That is, the relative positions and configurations of shank 12 and its pivotal axis about stock 18, the crown heads and sides, and pin 42 are such that as shank 12 is moved toward the right as seen in FIG. 3, the terminal position is defined by contact of pin 42 with curved portion 44 of crown side 30 and with the corresponding curved portion of crown side 28. Shank 12 will then be in the position shown in solid lines in FIG. 3.

In the event that the forces applied to anchor 10 tending to rotate shank 12 past the primary stop means exceed the strength of the materials, the primary stop means may fail by bending, breaking or deformation of pin 42 and/or the portions of crown sides 28 and 30 contacted thereby. When this occurs, shank 12 may be rotated further about its pivotal mounting on stock 18. Again, the relative positions and configuration of the elements are such that shank 12 may be rotated to the position indicated in FIG. 3 by reference numeral 12' where secondary stop means are provided by contact of the lower end of shank 12 with the inwardly facing surface of crown head 24 at the point indicated by reference numeral 48.

If the secondary stop means should fail, e.g., by the lower end of shank 12 breaking, bending or tearing the portion of the crown head which it contacts to define the secondary stop means, shaft may be rotated through a larger arc. In this case, tertiary stop means are provided by contact of an edge of shank 12 with the upper edge of crown head 26 at the point indicated by reference numeral 50 in FIG. 3, where the shank is in the position indicated at 12''. It will be understood, of course, that the operation of the three stop means is the same in the opposite direction of rotation of shank 12. That is, in addition to the three terminal positions shown in FIG. 3, there are three corresponding positions in which the stop means are provided by: 1. contact of pin 42 with curved portion 46 of crown side 30 and the adjacent curved portion of crown side 28, 2. contact of the lower end of shank 12 with the inwardly facing surface of crown head 26, and 3. contact of an edge portion of shank 12 with the upper edge of crown head 24. Shank 12 moves between flukes 14 and 16 in rotating from one to the other of its terminal positions and the arc of rotation between terminal positions defined by the same stop means is substantially bisected by the plane of the flukes. In this connection it should be noted that it is possible for one of the stop means to fail in one direction of shank rotation while remaining effective in the other. For example, if crown sides 28 and/or 30 should become deformed in the areas of curved portion 44 and/or the corresponding curved portion of crown side 28, the secondary stop means would then be operative in the positions shown in FIG. 3, while the primary stop means would remain operative (by pin 42 contacting undamaged curved portion 46, etc.) to define the opposite terminal position.

Thus, the kedge anchor design of the present invention provides three successively operable stop means defining the limits of pivotal movement of the shank relative to the other anchor elements. All three of the stop means in at least one direction of movement must fail before the anchor becomes unsuitable for the intended purpose.

I claim:

1. A kedge anchor comprising:

a.) a crown having first and second, substantially planar crown heads having respective top and bottom edges and lying in spaced, parallel planes with first and second crown sides extending therebetween and also lying in spaced, parallel planes which are perpendicular to said planes in which said crown heads lie, said crown sides each having bottom edges of predetermined configuration;

b.) an elongated stock extending laterally through said crown sides between and along an axis lying parallel to said planes in which said crown heads lie;

c.) first and second, longitudinally spaced flukes mounted to said stock on either side of said crown adjacent said crown sides and extending in the same direction from said stock;

d.) a shank having first and second ends, said shank pivotally mounted adjacent said first end about said stock between said crown sides whereby said shank may pivot in first and second, opposite directions between said crown sides and said flukes;

the improvement comprising:

e.) first, second and third, successively operable shank stop means, said first stop means limiting pivotal movement of said shank in both said first and second directions through an arc of a first distance and whereby, upon structural failure of said first stop means, said second stop means limits pivotal movement of said shank in both said first and second directions through an arc of a second distance larger than said first distance and whereby, upon structural failure of said first and second stop means, said third stop means limits pivotal movement of said shank in both said first and second directions through an arc of a third distance larger than said first and second distances.

2. The invention according to claim 1 wherein said first stop means comprises a pin extending laterally through said shank first end, said pin abutting said crown sides bottom edges upon said shank pivoting said first distance in either said first or second directions.

3. The invention according to claim 2 wherein said second stop means comprises said shank first end abutting said first and second crown heads upon said shank pivoting said second distance in either said first or second directions, respectively.

4. The invention according to claim 3 wherein said third stop means comprises a portion of said shank between said stock and said second end abutting said top edges of said first and second crown heads upon said shank pivoting said third distance in either said first or second directions, respectively.

* * * * *